US008064798B2

(12) United States Patent
Shinshi et al.

(10) Patent No.: US 8,064,798 B2
(45) Date of Patent: Nov. 22, 2011

(54) FIXING DEVICE AND IMAGE FORMING APPARATUS WITH HEATING MEMBER HEATED UNIFORMLY IN CIRCUMFERENTIAL DIRECTION

(75) Inventors: Akira Shinshi, Machida (JP); Kenichi Hasegawa, Atsugi (JP); Hiroshi Yoshinaga, Ichikawa (JP); Yasunori Ishigaya, Yokohama (JP); Ryota Yamashina, Koganei (JP)

(73) Assignee: Ricoh Company, Limited, Tokyo (JP)

( * ) Notice: Subject to any disclaimer, the term of this patent is extended or adjusted under 35 U.S.C. 154(b) by 98 days.

(21) Appl. No.: 12/575,818

(22) Filed: Oct. 8, 2009

(65) Prior Publication Data

US 2010/0092221 A1 Apr. 15, 2010

(30) Foreign Application Priority Data

Oct. 14, 2008 (JP) ..... 2008-265083

(51) Int. Cl.
*G03G 15/20* (2006.01)

(52) U.S. Cl. ..... 399/122; 399/330; 399/335

(58) Field of Classification Search ..... 399/122, 399/308, 328, 329, 330, 335; 347/156; 430/124.1, 430/124.3, 124.32
See application file for complete search history.

(56) References Cited

U.S. PATENT DOCUMENTS

| | | | |
|---|---|---|---|
| 5,839,043 | A | 11/1998 | Okabayashi et al. |
| 6,087,641 | A | 7/2000 | Kinouchi et al. |
| 7,127,204 | B2 | 10/2006 | Satoh et al. |
| 7,239,838 | B2 | 7/2007 | Sato et al. |
| 7,313,353 | B2 | 12/2007 | Satoh et al. |
| 2005/0141934 | A1 | 6/2005 | Kim et al. |
| 2007/0292175 | A1 | 12/2007 | Shinshi |
| 2008/0112739 | A1 | 5/2008 | Shinshi |
| 2008/0175633 | A1 | 7/2008 | Shinshi |
| 2008/0219730 | A1 | 9/2008 | Shinshi |
| 2008/0253788 | A1 | 10/2008 | Shinshi |
| 2008/0298862 | A1 | 12/2008 | Shinshi |
| 2009/0067902 | A1 | 3/2009 | Yoshinaga et al. |
| 2009/0123202 | A1 | 5/2009 | Yoshinaga et al. |
| 2009/0245865 | A1 | 10/2009 | Shinshi et al. |

FOREIGN PATENT DOCUMENTS

| | | | |
|---|---|---|---|
| EP | 1923752 | A1 | 5/2008 |
| EP | 1973011 | A1 | 9/2008 |
| JP | 2007-334205 | | 12/2007 |
| JP | 2008-158482 | | 7/2008 |

OTHER PUBLICATIONS

U.S. Appl. No. 12/588,295, filed Oct. 9, 2009.
U.S. Appl. No.12/482,684, filed Jun. 11, 2009, Akira Shinshi.

*Primary Examiner* — Mark R Gaworecki
(74) *Attorney, Agent, or Firm* — Oblon, Spivak, McClelland, Maier & Neustadt, L.L.P.

(57) ABSTRACT

In a fixing device, a belt moves in a predetermined direction to heat and melt a toner image on a recording medium. A pressing rotary member is pressed against the belt to form a nip portion to nip and convey the recording medium bearing the toner image. A heating member is fixedly provided inside a loop formed by the belt and faces an inner circumferential surface of the belt. The heating member is heated by a heater to heat the belt. The heating member includes a primary heating portion directly heated by the heater, and a secondary heating portion heated by heat conducted from the primary heating portion. The primary heating portion and the secondary heating portion are provided in a circumferential direction of the heating member. The secondary heating portion has a heat capacity smaller than a heat capacity of the primary heating portion.

16 Claims, 5 Drawing Sheets

FIXING DEVICE AND IMAGE FORMING APPARATUS WITH HEATING MEMBER HEATED UNIFORMLY IN CIRCUMFERENTIAL DIRECTION

CROSS-REFERENCE TO RELATED APPLICATION

The present application is based on and claims priority to Japanese Patent Application No. 2008-265083, filed on Oct. 14, 2008, in the Japan Patent Office, which is hereby incorporated herein by reference in its entirety.

BACKGROUND OF THE INVENTION

1. Field of the Invention

Exemplary aspects of the present invention relate to a fixing device and an image forming apparatus, and more particularly, to a fixing device for fixing a toner image on a recording medium and an image forming apparatus including the fixing device.

2. Description of the Related Art

Related-art image forming apparatuses, such as copiers, facsimile machines, printers, or multifunction printers having at least one of copying, printing, scanning, and facsimile functions, typically form an image on a recording medium (e.g., a transfer sheet) according to image data. Thus, for example, a charger uniformly charges a surface of an image carrier; an optical writer emits a light beam onto the charged surface of the image carrier to form an electrostatic latent image on the image carrier according to the image data; a development device supplies toner to the electrostatic latent image formed on the image carrier to make the electrostatic latent image visible as a toner image; the toner image is directly transferred from the image carrier onto a recording medium or is indirectly transferred from the image carrier onto a recording medium via an intermediate transfer member; a cleaner then cleans the surface of the image carrier after the toner image is transferred from the image carrier onto the recording medium; finally, a fixing device applies heat and pressure to the recording medium bearing the toner image to fix the toner image on the recording medium, thus forming the image on the recording medium.

Market demand for high-speed image forming apparatuses requires that a toner image be fixed on a recording medium properly in the fixing device even when the image forming apparatus forms the toner image on the recording medium at high speed with a shortened warm-up time and first print.

To address such demand, the fixing device may include a heating member such as a heat-conductive metal pipe provided inside a loop formed by an endless belt and facing an inner circumferential surface of the belt. A heater provided inside the heating member heats the heating member and the heating member heats the whole belt.

More specifically, the heating member is pressed against a pressing rotary member located outside the loop formed by the belt via the belt to form a nip portion between the pressing rotary member and the belt that nips a recording medium bearing a toner image as the recording medium passes through the nip portion. A reinforcement member is provided inside the heating member to press against the pressing rotary member via the heating member and the belt so as to reinforce the heating member at the nip portion. The heater provided inside the heating member heats the belt via the heating member.

With such a structure, the recording medium bearing the toner image passing through the nip portion receives heat from the belt and pressure from the pressing rotary member to fix the toner image on the recording medium.

However, in such a fixing device, sufficient time is needed to warm up the belt. Otherwise, the belt may not be heated uniformly in a circumferential direction of the belt. Uneven or incomplete heating of the belt in the circumferential direction may cause the toner image to be fixed on the recording medium unevenly or may cause localized hot offsets on the toner image.

One prominent reason why the heater may not heat the heating member uniformly in the circumferential direction of the heating member may rest with the structure of the heating member itself. That is, the heating member may be constituted so as to include a primary heating portion directly heated by the heater and a secondary heating portion continuous with and adjacent to the primary heating portion and heated indirectly by heat conducted from the primary heating portion.

Also, the reinforcement member may block radiation heat generated by the heater toward the heating member. Accordingly, a part of the heating member may not be heated by the radiation heat.

Failure of the heater to heat the heating member uniformly in the circumferential direction of the heating member may result in failure of the heating member to expand thermally uniformly in the circumferential direction of the heating member. Consequently, parts of the heating member may come into substantial frictional contact with the belt, interfering with movement of the belt and adversely affecting the durability of the belt.

BRIEF SUMMARY OF THE INVENTION

This specification describes below a fixing device according to an exemplary embodiment of the present invention. In one exemplary embodiment of the present invention, the fixing device includes a flexible endless belt, a pressing rotary member, a heater, and a heating member. The flexible endless belt moves in a predetermined direction to heat and melt a toner image on a recording medium. The pressing rotary member is pressed against the belt to form a nip portion to nip and convey the recording medium bearing the toner image as the recording medium passes between the pressing rotary member and the belt. The heater generates heat. The heating member is fixedly provided inside a loop formed by the belt and faces an inner circumferential surface of the belt. The heating member is heated by the heater to heat the belt. The heating member includes a primary heating portion directly heated by the heater, and a secondary heating portion continuous with and adjacent to the primary heating portion and heated by heat conducted from the primary heating portion. The primary heating portion and the secondary heating portion are provided in a circumferential direction of the heating member. The secondary heating portion has a heat capacity smaller than a heat capacity of the primary heating portion.

This specification describes below an image forming apparatus according to an exemplary embodiment of the present invention. In one exemplary embodiment of the present invention, the image forming apparatus includes a fixing device including a flexible endless belt, a pressing rotary member, a heater, and a heating member. The flexible endless belt moves in a predetermined direction to heat and melt a toner image on a recording medium. The pressing rotary member is pressed against the belt to form a nip portion to nip and convey the recording medium bearing the toner image as the recording medium passes between the pressing rotary member and the belt. The heater generates heat. The heating member is fixedly provided inside a loop formed by the belt and faces an inner circumferential surface of the belt. The heating member is heated by the heater to heat the belt. The heating member includes a primary heating portion directly heated by the heater, and a secondary heating portion continuous with and adjacent to the primary heating portion and heated by heat conducted from the primary heating portion. The primary heating portion and the secondary heating portion are provided in a circumferential direction of the heating member. The secondary heating portion has a heat capacity smaller than a heat capacity of the primary heating portion.

BRIEF DESCRIPTION OF THE DRAWINGS

A more complete appreciation of the invention and the many attendant advantages thereof will be readily obtained as the same becomes better understood by reference to the following detailed description when considered in connection with the accompanying drawings, wherein.

DETAILED DESCRIPTION OF THE INVENTION

Figure 1:
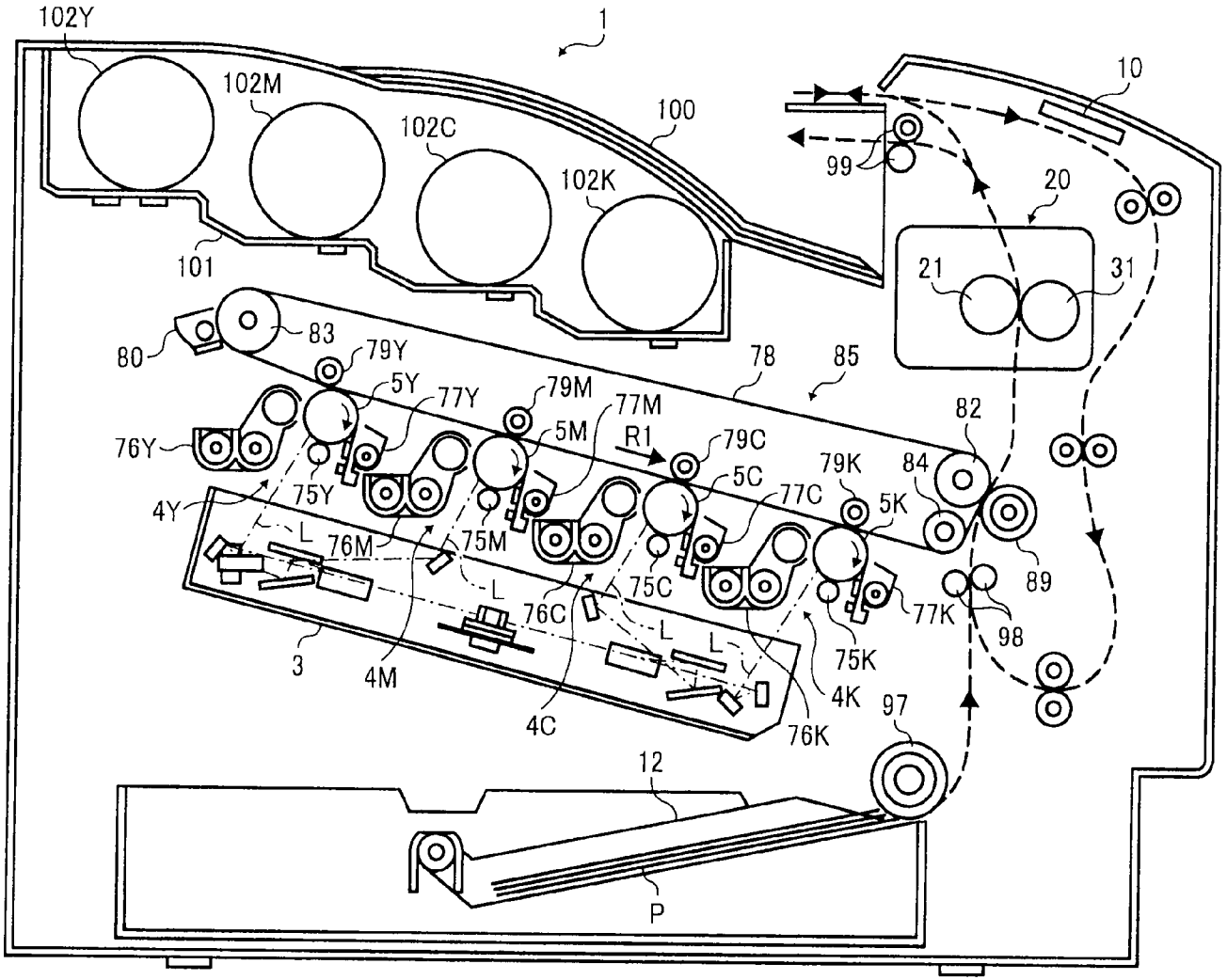
FIG. 1 is a schematic view of an image forming apparatus according to an exemplary embodiment of the present invention.

In describing exemplary embodiments illustrated in the drawings, specific terminology is employed for the sake of clarity. However, the disclosure of this specification is not intended to be limited to the specific terminology so selected and it is to be understood that each specific element includes all technical equivalents that operate in a similar manner.

Referring now to the drawings, wherein like reference numerals designate identical or corresponding parts throughout the several views, in particular to FIG. 1, an image forming apparatus 1 according to an exemplary embodiment of the present invention is explained.

FIG. 1 is a schematic view of the image forming apparatus 1. As illustrated in FIG. 1, the image forming apparatus 1 includes an exposure device 3, image forming devices 4Y, 4M, 4C, and 4K, a controller 10, a paper tray 12, a fixing device 20, an intermediate transfer unit 85, a second transfer roller 89, a feed roller 97, a registration roller pair 98, an output roller pair 99, a stack portion 100, and a toner bottle holder 101. The image forming devices 4Y, 4M, 4C, and 4K include photoconductive drums 5Y, 5M, 5C, and 5K, chargers 75Y, 75M, 75C, and 75K, development devices 76Y, 76M, 76C, and 76K, and cleaners 77Y, 77M, 77C, and 77K, respectively.

The fixing device 20 includes a fixing belt 21 and a pressing roller 31.

The intermediate transfer unit 85 includes an intermediate transfer belt 78, first transfer bias rollers 79Y, 79M, 79C, and 79K, an intermediate transfer cleaner 80, a second transfer backup roller 82, a cleaning backup roller 83, and a tension roller 84.

The toner bottle holder 101 includes toner bottles 102Y, 102M, 102C, and 102K.

As illustrated in FIG. 1, the image forming apparatus 1 can be a copier, a facsimile machine, a printer, a multifunction printer having at least one of copying, printing, scanning, plotter, and facsimile functions, or the like. According to this exemplary embodiment of the present invention, the image forming apparatus 1 functions as a tandem color printer for forming a color image on a recording medium.

The toner bottle holder 101 is provided in an upper portion of the image forming apparatus 1. The four toner bottles 102Y, 102M, 102C, and 102K contain yellow, magenta, cyan, and black toners, respectively, and are detachably attached to the toner bottle holder 101 so that the toner bottles 102Y, 102M, 102C, and 102K are replaced with new ones.

The intermediate transfer unit 85 is provided below the toner bottle holder 101. The image forming devices 4Y, 4M, 4C, and 4K are arranged to oppose the intermediate transfer belt 78 of the intermediate transfer unit 85, and form yellow, magenta, cyan, and black toner images, respectively.

In the image forming devices 4Y, 4M, 4C, and 4K, the chargers 75Y, 75M, 75C, and 75K, the development devices 76Y, 76M, 76C, and 76K, the cleaners 77Y, 77M, 77C, and 77K, and dischargers surround the photoconductive drums 5Y, 5M, 5C, and 5K, respectively. Image forming processes including a charging process, an exposure process, a development process, a transfer process, and a cleaning process are performed on the photoconductive drums 5Y, 5M, 5C, and 5K to form yellow, magenta, cyan, and black toner images on the photoconductive drums 5Y, 5M, 5C, and 5K, respectively.

A driving motor drives and rotates the photoconductive drums 5Y, 5M, 5C, and 5K clockwise in FIG. 1. In the charging process, the chargers 75Y, 75M, 75C, and 75K uniformly charge surfaces of the photoconductive drums 5Y, 5M, 5C, and 5K at charging positions at which the chargers 75Y, 75M, 75C, and 75K oppose the photoconductive drums 5Y, 5M, 5C, and 5K, respectively.

In the exposure process, the exposure device 3 emits laser beams L onto the charged surfaces of the photoconductive drums 5Y, 5M, 5C, and 5K, respectively. In other words, the exposure device 3 scans and exposes the charged surfaces of the photoconductive drums 5Y, 5M, 5C, and 5K at irradiation positions at which the exposure device 3 opposes and irradiates the charged surfaces of the photoconductive drums 5Y, 5M, 5C, and 5K to form electrostatic latent images corresponding to yellow, magenta, cyan, and black colors, respectively.

In the development process, the development devices 76Y, 76M, 76C, and 76K make the electrostatic latent images formed on the surfaces of the photoconductive drums 5Y, 5M, 5C, and 5K visible as yellow, magenta, cyan, and black toner images at development positions at which the development devices 76Y, 76M, 76C, and 76K oppose the photoconductive drums 5Y, 5M, 5C, and 5K, respectively.

In the transfer process, the first transfer bias rollers 79Y, 79M, 79C, and 79K transfer and superimpose the yellow, magenta, cyan, and black toner images formed on the photoconductive drums 5Y, 5M, 5C, and 5K onto the intermediate transfer belt 78 at first transfer positions at which the first transfer bias rollers 79Y, 79M, 79C, and 79K oppose the photoconductive drums 5Y, 5M, 5C, and 5K via the intermediate transfer belt 78, respectively. Thus, a color toner image is formed on the intermediate transfer belt 78. After the transfer of the yellow, magenta, cyan, and black toner images, a slight amount of residual toner, which has not been transferred onto the intermediate transfer belt 78, remains on the photoconductive drums 5Y, 5M, 5C, and 5K.

In the cleaning process, cleaning blades included in the cleaners 77Y, 77M, 77C, and 77K mechanically collect the residual toner from the photoconductive drums 5Y, 5M, 5C, and 5K at cleaning positions at which the cleaners 77Y, 77M, 77C, and 77K oppose the photoconductive drums 5Y, 5M, 5C, and 5K, respectively.

Finally, dischargers remove residual potential on the photoconductive drums 5Y, 5M, 5C, and 5K at discharging positions at which the dischargers oppose the photoconductive drums 5Y, 5M, 5C, and 5K, respectively. Thus, a series of image forming processes performed on the photoconductive drums 5Y, 5M, 5C, and 5K is finished.

The intermediate transfer belt 78 is supported by and looped over three rollers, which are the second transfer backup roller 82, the cleaning backup roller 83, and the tension roller 84. A single roller, that is, the second transfer backup roller 82, drives and endlessly moves (e.g., rotates) the intermediate transfer belt 78 in a direction R1.

The four first transfer bias rollers 79Y, 79M, 79C, and 79K and the photoconductive drums 5Y, 5M, 5C, and 5K sandwich the intermediate transfer belt 78 to form first transfer nip portions, respectively. The first transfer bias rollers 79Y, 79M, 79C, and 79K are applied with a transfer bias having a polarity opposite to a polarity of toner forming the yellow, magenta, cyan, and black toner images on the photoconductive drums 5Y, 5M, 5C, and 5K, respectively. Accordingly, the yellow, magenta, cyan, and black toner images formed on the photoconductive drums 5Y, 5M, 5C, and 5K, respectively, are transferred and superimposed onto the intermediate transfer belt 78 rotating in the direction R1 successively at the first transfer nip portions formed between the photoconductive drums 5Y, 5M, 5C, and 5K and the intermediate transfer belt 78. Thus, the color toner image is formed on the intermediate transfer belt 78.

The paper tray 12 is provided in a lower portion of the image forming apparatus 1, and loads a plurality of transfer sheets P serving as recording media. The feed roller 97 rotates counterclockwise in FIG. 1 to feed an uppermost transfer sheet P of the plurality of transfer sheets P loaded on the paper tray 12 toward the registration roller pair 98.

The registration roller pair 98, which stops rotating temporarily, stops the uppermost transfer sheet P fed by the feed roller 97. For example, a roller nip portion formed between two rollers of the registration roller pair 98 contacts and stops a leading edge of the transfer sheet P. The registration roller pair 98 starts rotating to feed the transfer sheet P to a second transfer nip portion formed between the second transfer roller 89 and the intermediate transfer belt 78 at a time at which the color toner image formed on the intermediate transfer belt 78 reaches the second transfer nip portion.

At the second transfer nip portion, the second transfer roller 89 and the second transfer backup roller 82 sandwich the intermediate transfer belt 78. The second transfer roller 89 transfers the color toner image formed on the intermediate transfer belt 78 onto the transfer sheet P fed by the registration roller pair 98 at the second transfer nip portion formed between the second transfer roller 89 and the intermediate transfer belt 78. Thus, the desired color toner image is formed on the transfer sheet P. After the transfer of the color toner image, residual toner, which has not been transferred onto the transfer sheet P, remains on the intermediate transfer belt 78.

The intermediate transfer cleaner 80 collects the residual toner from the intermediate transfer belt 78 at a cleaning position at which the intermediate transfer cleaner 80 opposes the intermediate transfer belt 78.

Thus, a series of transfer processes performed on the intermediate transfer belt 78 is finished.

The transfer sheet P bearing the color toner image is sent to the fixing device 20. In the fixing device 20, the fixing belt 21 and the pressing roller 31 apply heat and pressure to the transfer sheet P to fix the color toner image on the transfer sheet P.

Thereafter, the fixing device 20 feeds the transfer sheet P bearing the fixed color toner image toward the output roller pair 99. The output roller pair 99 discharges the transfer sheet P to an outside of the image forming apparatus 1, that is, the stack portion 100. Thus, the transfer sheets P discharged by the output roller pair 99 are stacked on the stack portion 100 successively. Accordingly, a series of image forming processes performed by the image forming apparatus 1 is finished.

The controller 10 controls operations of the image forming apparatus 1.

Referring to FIGS. 2 to 5, the following describes a structure and operations of the fixing device 20.

Figure 2:
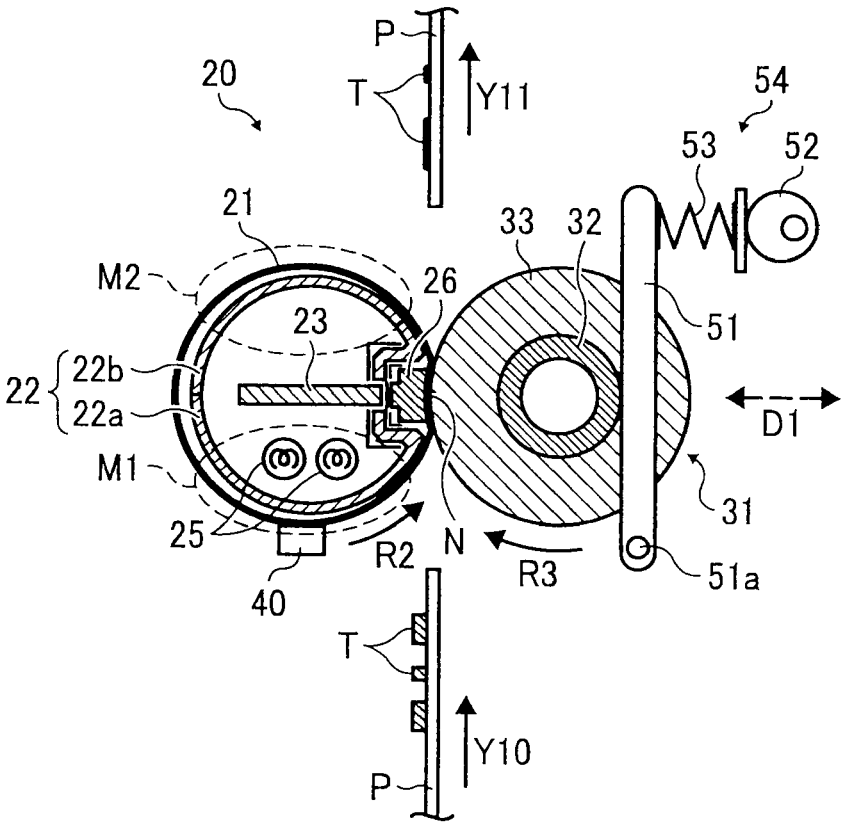
FIG. 2 is a schematic view of a fixing device included in the image forming apparatus shown in FIG. 1.

FIG. 2 is a schematic view of the fixing device 20. As illustrated in FIG. 2, the fixing device 20 further includes a heating member 22, a reinforcement member 23, a heater 25, a fixed member 26, a temperature sensor 40, and a contact-separate mechanism 54.

The heating member 22 includes a primary heating portion 22*a* and a secondary heating portion 22*b*.

The contact-separate mechanism 54 includes a pressing lever 51, an eccentric cam 52, and a pressing spring 53. The pressing lever 51 includes a support shaft 51*a*.

The pressing roller 31 includes a core metal 32 and an elastic layer 33.

Figure 3:
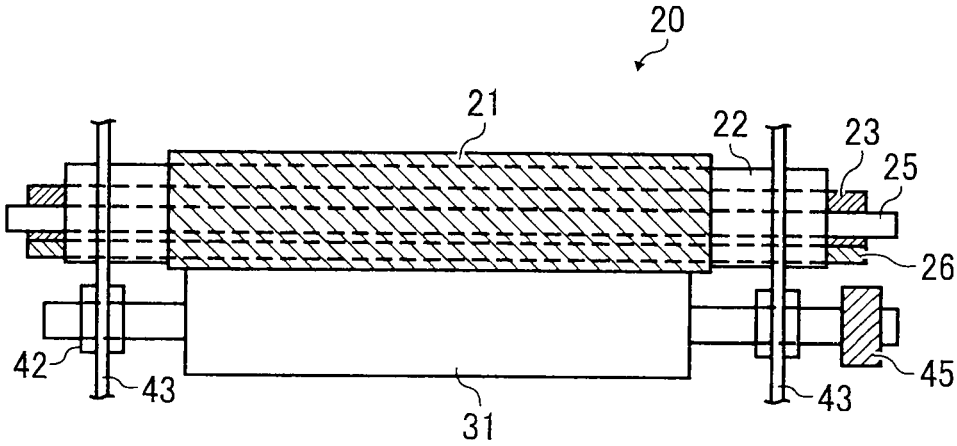
FIG. 3 is an axial view of the fixing device shown in FIG. 2 in a width direction of the fixing device.

FIG. 3 is an axial view of the fixing device 20 in a width direction of the fixing device 20. As illustrated in FIG. 3, the fixing device 20 further includes bearings 42, side plates 43, and a gear 45.

Figure 4:
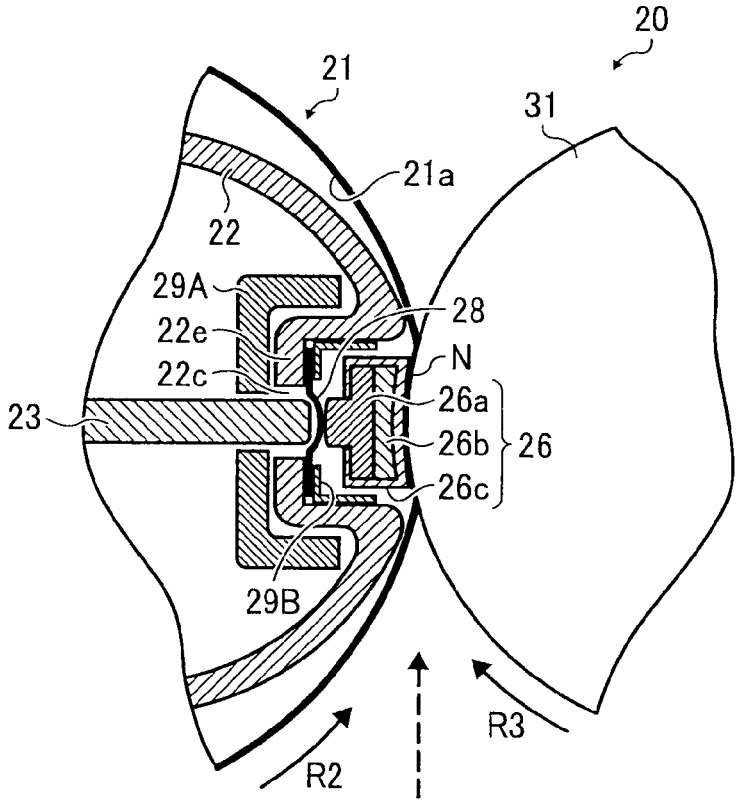
FIG. 4 is a partially enlarged view of the fixing device shown in FIG. 2.

FIG. 4 is a partially enlarged view of the fixing device 20. As illustrated in FIG. 4, the fixing device 20 further includes a seal member 28, a first stay 29A, and a second stay 29B. The fixing belt 21 includes an inner circumferential surface 21*a*. The heating member 22 further includes an opening 22*c* and a concave portion 22*e*. The fixed member 26 includes a rigid portion 26*a*, an elastic portion 26*b*, and a lubricating sheet 26*c*.

Figure 5:
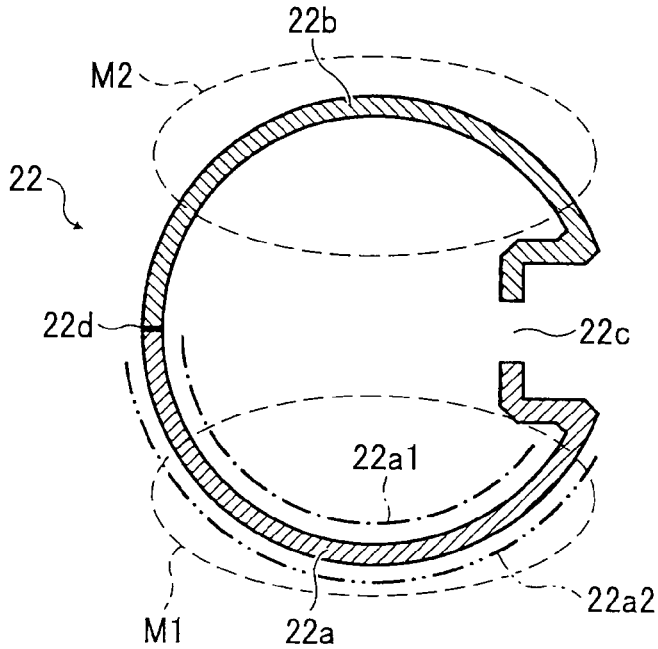
FIG. 5 is a side view of one example of a heating member included in the fixing device shown in FIG. 4.

FIG. 5 is a side view of the heating member 22. As illustrated in FIG. 5, the heating member 22 further includes a black-coated surface 22*a*1, a slide layer 22*a*2, and a joint 22*d*.

As illustrated in FIG. 2, the fixing belt 21 serves as a thin endless belt which is flexible and bendable, and rotates or moves counterclockwise in FIG. 2 in a rotation direction R2. Namely, the fixing belt 21 moves in a predetermined direction to heat and melt a toner image T on a transfer sheet P serving as a recording medium. The fixing belt 21 includes a base layer, an elastic layer, and a releasing layer in such a manner that the base layer, the elastic layer, and the releasing layer are layered in this order from the inner circumferential surface 21*a* (depicted in FIG. 4) sliding over the fixed member 26 to an outer circumferential surface so that the fixing belt 21 has a thickness not greater than about 1 mm.

The base layer of the fixing belt 21 has a thickness in a range from about 30 μm to about 50 μm, and includes a metal material such as nickel and/or stainless steel and/or a resin material such as polyimide.

The elastic layer of the fixing belt 21 has a thickness in a range from about 100 μm to about 300 μm, and includes a rubber material such as silicon rubber, silicon rubber foam, and/or fluorocarbon rubber. The elastic layer prevents or reduces slight surface asperities of the fixing belt 21 generating at a nip portion N formed between the fixing belt 21 and the pressing roller 31. Accordingly, heat is uniformly transmitted from the fixing belt 21 to a toner image T on a transfer sheet P, suppressing formation of a rough image such as an orange peel image.

The releasing layer of the fixing belt 21 has a thickness in a range from about 10 μm to about 50 μm, and includes PFA (tetrafluoroethylene-perfluoroalkyl vinyl ether copolymer), PTFE (polytetrafluoroethylene), polyimide, polyetherimide, and/or PES (polyether sulfide). The releasing layer releases or separates a toner image T from the fixing belt 21.

The fixing belt 21 has a diameter in a range from about 15 mm to about 120 mm. According to this exemplary embodiment, the fixing belt 21 has a diameter of about 30 mm.

As illustrated in FIGS. 2 and 4, the fixed member 26, the heater 25 serving as a heater or a heat source, the heating member 22, the reinforcement member 23 serving as a reinforcement member or a support member, the first stay 29A, the second stay 29B, and the seal member 28 (e.g., a sheet member) are fixedly provided inside a loop formed by the fixing belt 21 serving as a belt. In other words, the fixed member 26, the heater 25, the heating member 22, the reinforcement member 23, the first stay 29A, the second stay 29B, and the seal member 28 do not face the outer circumferential surface of the fixing belt 21, but face the inner circumferential surface 21*a* of the fixing belt 21.

The fixed member 26 serves as a fixed member fixedly provided inside the loop formed by the fixing belt 21 and facing the inner circumferential surface 21*a* of the fixing belt 21 in such a manner that the inner circumferential surface 21*a* of the fixing belt 21 slidably contacts the fixed member 26. The fixed member 26 is pressed against the pressing roller 31 via the fixing belt 21 to form the nip portion N between the pressing roller 31 and the fixing belt 21 to nip and feed a transfer sheet P. As illustrated in FIG. 3, both ends of the fixed member 26 in a width direction of the fixed member 26, that is, in an axial direction of the fixing belt 21, are fixedly mounted on the side plates 43 of the fixing device 20, respectively, in such a manner that the side plates 43 support the fixed member 26.

As illustrated in FIG. 4, in the fixed member 26, the rigid portion 26*a* includes a metal material. The elastic portion 26*b* includes a rubber material. The lubricating sheet 26*c* covers the rigid portion 26*a* and the elastic portion 26*b*. A protrusion of the rigid portion 26*a* protrudes toward the reinforcement member 23 and is pressed against the reinforcement member 23 via the seal member 28. The rigid portion 26*a* includes a rigid material such as high-rigid metal and/or ceramic so that the rigid portion 26*a* may not be bent substantially even when the rigid portion 26*a* receives pressure from the pressing roller 31. An outer circumferential surface of the elastic portion 26*b* and the rigid portion 26*a* opposing the pressing roller 31 has a concave shape corresponding to a curvature of the pressing roller 31. Accordingly, a transfer sheet P bearing a fixed toner image T is sent out of the nip portion N to correspond to the curvature of the pressing roller 31. Consequently, the transfer sheet P bearing the fixed toner image T may not be attracted to the fixing belt 21 and may separate from the fixing belt 21.

The elastic portion 26*b* of the fixed member 26 is provided on the rigid portion 26*a* of the fixed member 26 in such a manner that the elastic portion 26*b* is disposed closer to the nip portion N than the rigid portion 26*a* is. Thus, the elastic portion 26*b* of the fixed member 26 corresponds to a slightly rough surface of a toner image T on a transfer sheet P passing through the nip portion N. Consequently, the fixing device 20 can fix the toner image T on the transfer sheet P properly.

As illustrated in FIG. 4, an outer circumferential surface of the lubricating sheet 26*c* of the fixed member 26 is impregnated with a lubricant such as fluorine grease, decreasing resistance generated between the fixed member 26 and the fixing belt 21 sliding over the fixed member 26.

According to this exemplary embodiment, the fixed member 26 for forming the nip portion N has the concave shape. Alternatively, the fixed member 26 may have a planar shape. For example, a slide surface of the fixed member 26, that is, an outer surface of the fixed member 26 opposing the pressing roller 31, may have a planer shape. Accordingly, the nip portion N is substantially parallel to a surface of a transfer sheet P bearing a toner image T. In other words, the fixing belt 21 contacts the transfer sheet P tightly to improve fixing property. Further, an increased curvature of the fixing belt 21 at an exit of the nip portion N separates the transfer sheet P sent out of the nip portion N from the fixing belt 21 easily.

As illustrated in FIGS. 2 and 4, the heating member 22 includes a pipe member having a thickness of about 0.1 mm. The heating member 22 serves as a heating member fixedly provided inside the loop formed by the fixing belt 21 and facing the inner circumferential surface 21*a* of the fixing belt 21. The heating member 22 is heated by the heater 25 so as to heat the fixing belt 21. The heating member 22 directly faces the inner circumferential surface 21*a* of the fixing belt 21 at a portion of the fixing belt 21 other than the nip portion N. At the nip portion N, the heating member 22 has a concave shape to form the concave portion 22*e* provided with the opening 22*c*. The fixed member 26 is inserted into the concave portion 22*e* of the heating member 22 in such a manner that a clearance is provided between the fixed member 26 and the heating member 22. As illustrated in FIG. 3, both ends of the heating member 22 in a width direction of the heating member 22, that is, in the axial direction of the fixing belt 21, are fixedly mounted on the side plates 43 of the fixing device 20, respectively, in such a manner that the side plates 43 support the heating member 22.

As illustrated in FIG. 2, radiation heat (e.g., radiation light) generated by the heater 25 heats the heating member 22 so that the heating member 22 heats the fixing belt 21. In other words, the heater 25 indirectly heats the fixing belt 21 via the heating member 22. The heating member 22 may include a metallic heat conductor, that is, a metal having thermal conductivity, such as aluminum, iron, and/or stainless steel. When the heating member 22 has a thickness not greater than about 0.2 mm, the heating member 22 provides an improved heating efficiency for heating the heating member 22 and the fixing belt 21.

The heater 25, serving as a heater or a heat source, includes a halogen heater and/or a carbon heater. As illustrated in FIG. 3, both ends of the heater 25 in a width direction of the heater 25, that is, in the axial direction of the fixing belt 21, are fixedly mounted on the side plates 43 of the fixing device 20. Radiation heat generated by the heater 25, which is controlled by a power source provided in the image forming apparatus 1 depicted in FIG. 1, heats the heating member 22. The heating member 22 heats a substantially whole portion of the fixing belt 21. In other words, the heating member 22 heats a portion of the fixing belt 21 other than the nip portion N. Heat is transmitted from the heated outer circumferential surface of the fixing belt 21 to the toner image T on the transfer sheet P.

As illustrated in FIG. 2, the temperature sensor 40, such as a thermistor, opposes the outer circumferential surface of the fixing belt 21 to detect temperature of the outer circumferential surface of the fixing belt 21. The controller 10 depicted in FIG. 1 controls the heater 25 according to a detection result provided by the temperature sensor 40 so as to adjust the temperature (e.g., a fixing temperature) of the fixing belt 21 to a desired temperature.

As described above, in the fixing device 20 according to this exemplary embodiment, the heating member 22 does not heat a small part of the fixing belt 21 but heats a substantial region of the fixing belt 21 in a circumferential direction of the fixing belt 21. Accordingly, even when the image forming apparatus 1 depicted in FIG. 1 forms a toner image at a high speed, the fixing belt 21 is heated sufficiently to suppress fixing failure. In other words, the relatively simple structure of the fixing device 20 heats the fixing belt 21 efficiently, resulting in a shortened warm-up time period, a shortened first print time period, and the compact image foaming apparatus 1.

A gap δ formed between the fixing belt 21 and the heating member 22 at a position other than the nip portion N may have a size greater than 0 mm and not greater than 1 mm, which is shown as $0\ \text{mm} < \delta \leqq 1\ \text{mm}$. Accordingly, the fixing belt 21 does not slidably contact the heating member 22 at an increased area, suppressing wear of the fixing belt 21. Further, a substantial clearance is not provided between the heating member 22 and the fixing belt 21, suppressing decrease in heating efficiency for heating the fixing belt 21. Moreover, the heating member 22 disposed close to the fixing belt 21 maintains the circular loop formed by the flexible fixing belt 21, decreasing degradation and damage of the fixing belt 21 due to deformation of the fixing belt 21.

A lubricant, such as fluorine grease and/or silicon oil, is applied between the fixing belt 21 and the heating member 22 to decrease wear of the fixing belt 21 even when the fixing belt 21 slidably contacts the heating member 22.

According to this exemplary embodiment, the heating member 22 has a substantially circular shape in cross-section. Alternatively, the heating member 22 may have a polygonal shape in cross-section.

The reinforcement member 23, serving as a support member or a reinforcement member, supports and reinforces the fixed member 26 which forms the nip portion N between the fixing belt 21 and the pressing roller 31. The reinforcement member 23 is fixedly provided inside the loop formed by the fixing belt 21 and faces the inner circumferential surface 21*a* of the fixing belt 21. In other words, the reinforcement member 23 serves as a reinforcement member fixedly provided inside the heating member 22 and facing an inner circumferential surface of the heating member 22 to directly or indirectly contact the fixed member 26 to reinforce the fixed member 26.

As illustrated in FIG. 3, width of the reinforcement member 23 in a width direction of the reinforcement member 23, that is, in the axial direction of the fixing belt 21, is equivalent to width of the fixed member 26 in the width direction of the fixed member 26, that is, in the axial direction of the fixing belt 21. Both ends of the reinforcement member 23 in the width direction of the reinforcement member 23, that is, in the axial direction of the fixing belt 21, are fixedly mounted on the side plates 43 of the fixing device 20 in such a manner that the side plates 43 support the reinforcement member 23. As illustrated in FIG. 4, the reinforcement member 23 is pressed against the pressing roller 31 serving as a pressing rotary member via the seal member 28, the fixed member 26, and the fixing belt 21. Thus, the fixed member 26 may not be deformed substantially when the fixed member 26 receives pressure applied by the pressing roller 31 at the nip portion N.

In order to provide the above-described functions, the reinforcement member 23 may include a metal material, such as stainless steel and/or iron, providing a high mechanical strength. An opposing surface of the reinforcement member 23 opposing the heater 25 depicted in FIG. 2 may include a heat insulation material partially or wholly. Alternatively, the opposing surface of the reinforcement member 23 opposing the heater 25 may be bright-annealed or mirror-ground. Accordingly, heat output by the heater 25 toward the reinforcement member 23 to heat the reinforcement member 23 is used to heat the heating member 22, improving heating efficiency for heating the heating member 22 and the fixing belt 21.

As illustrated in FIG. 4, the opening 22*c* is provided in the heating member 22 at a position opposing the pressing roller 31. The seal member 28 (e.g., a sheet member) covers the opening 22*c* of the heating member 22 to prevent the lubricant from entering the heating member 22 through the opening 22*c* of the heating member 22. For example, when the lubricant applied between the heating member 22 and the fixing belt 21 enters the heating member 22, shortage of the lubricant may increase resistance generated between the heating member 22 and the fixing belt 21 sliding over the heating member 22 to accelerate wear or degradation of the heating member 22 and the fixing belt 21. Further, the lubricant entering the heating member 22 may be adhered to the heater 25 depicted in FIG. 2. Consequently, the heater 25 may degrade or the lubricant may vaporize.

The reinforcement member 23 fixedly provided inside the heating member 22 in such a manner that the reinforcement member 23 faces the inner circumferential surface of the heating member 22 opposes the fixed member 26 via the seal member 28. In other words, the reinforcement member 23 reinforces and supports the fixed member 26 serving as a fixed member or a nip portion formation member for forming the nip portion N. For example, the seal member 28 may be a deformable thin film member or a deformable thin sheet member including at least one of silicon rubber, fluorocarbon rubber, and fluorocarbon resin and having a thickness in a range from about 0.1 mm to about 0.5 mm. According to this exemplary embodiment, the seal member 28 includes silicon rubber. A head of the reinforcement member 23 protruding from the opening 22*c* of the heating member 22 toward the fixed member 26 deforms the seal member 28 and is pressed against the fixed member 26 via the seal member 28.

With the above-described structure, the pressing roller 31 does not apply pressure to the heating member 22. Accordingly, even when the heating member 22 has a decreased thickness or the pressing roller 31 applies increased pressure to the fixing belt 21, the heating member 22 may not be deformed. Moreover, even when the pressing roller 31 contacts to and separates from the fixing belt 21, the heating member 22 may not be deformed.

Even when the reinforcement member 23 is deformed by pressure applied by the pressing roller 31 and the fixed member 26 moves leftward in FIG. 4, the clearance provided between the fixed member 26 and the concave portion 22*e* of the heating member 22 prevents the fixed member 26 from pressing against the concave portion 22*e* of the heating member 22.

The second stay 29B is provided at a circumference (e.g., edges) of the opening 22*c* of the heating member 22 in such a manner that the second stay 29B and the heating member 22 sandwich the seal member 28. The second stay 29B may be a stainless steel plate having a thickness of about 0.5 mm and having a box shape, and is press-fitted into the concave portion 22*e* of the heating member 22 in such a manner that the second stay 29B and the concave portion 22*e* of the heating member 22 sandwich the seal member 28. Accordingly, margins of the seal member 28 contact the heating member 22 tightly to prevent or reduce the lubricant entering the heating member 22.

The first stay 29A may be a stainless steel plate having a U-like shape and a thickness of about 1.5 mm. The first stay 29A engages and covers an inner circumferential surface of the concave portion 22*e* of the heating member 22 to form the concave portion 22*e* precisely. In order to improve heating efficiency for heating the heating member 22, an opposing surface of the first stay 29A opposing the heater 25 may be bright-annealed or mirror-ground.

As illustrated in FIG. 2, the pressing roller 31 serves as a pressing rotary member pressed against the fixing belt 21 to form the nip portion N to nip and convey a transfer sheet P bearing a toner image T as the transfer sheet P passes between the pressing roller 31 and the fixing belt 21. The pressing roller 31 opposes and contacts the outer circumferential surface of the fixing belt 21 at the nip portion N, and has a diameter of about 30 mm. In the pressing roller 31, the elastic layer 33 is formed on the hollow core metal 32. The elastic layer 33 includes silicon rubber foam, silicon rubber, and/or fluorocarbon rubber. A thin releasing layer including PFA and/or PTFE may be formed on the elastic layer 33 to serve as a surface layer. The pressing roller 31 is pressed against the fixing belt 21 to form the desired nip portion N between the pressing roller 31 and the fixing belt 21.

As illustrated in FIG. 3, the gear 45 engaging a driving gear of a driving mechanism is mounted on the pressing roller 31 to rotate the pressing roller 31 clockwise in FIG. 2 in a rotation direction R3. Both ends of the pressing roller 31 in a width direction of the pressing roller 31, that is, in an axial direction of the pressing roller 31, are rotatably supported by the side plates 43 of the fixing device 20 via the bearings 42, respectively. A heat source, such as a halogen heater, may be provided inside the pressing roller 31.

When the elastic layer 33 of the pressing roller 31 includes a sponge material such as silicon rubber foam, the pressing roller 31 applies decreased pressure to the nip portion N to decrease bending of the fixed member 26. Further, the pressing roller 31 provides increased heat insulation, and therefore heat is not transmitted from the fixing belt 21 to the pressing roller 31 easily, improving heating efficiency for heating the fixing belt 21.

According to this exemplary embodiment, the diameter of the fixing belt 21 is equivalent to the diameter of the pressing roller 31. Alternatively, the diameter of the fixing belt 21 may be smaller than the diameter of the pressing roller 31. In this case, a curvature of the fixing belt 21 is smaller than a curvature of the pressing roller 31 at the nip portion N, and therefore a transfer sheet P separates from the fixing belt 21 easily when the transfer sheet P is fed out of the nip portion N.

Yet alternatively, the diameter of the fixing belt 21 may be greater than the diameter of the pressing roller 31. In this case, the pressing roller 31 does not apply pressure to the heating member 22 regardless of a relation between the diameter of the fixing belt 21 and the diameter of the pressing roller 31.

As illustrated in FIG. 2, the contact-separate mechanism 54 moves the pressing roller 31 with respect to the fixing belt 21 so that the pressing roller 31 contacts to and separates from the fixing belt 21. In the contact-separate mechanism 54, the pressing lever 51 is rotatably supported by the side plate 43 (depicted in FIG. 3) of the fixing device 20 via the support shaft 51*a* provided at one end of the pressing lever 51 in a longitudinal direction of the pressing lever 51 (e.g., a direction perpendicular to the axial direction of the pressing roller 31), in such a manner that the pressing lever 51 rotates about the support shaft 51*a*. A center portion of the pressing lever 51 in the longitudinal direction of the pressing lever 51 contacts the bearing 42 (depicted in FIG. 3) of the pressing roller 31, which is movably held in an elongate hole provided in the side plate 43. The pressing spring 53 is connected to another end of the pressing lever 51 in the longitudinal direction of the pressing lever 51. The eccentric cam 52 engages a hold plate for holding the pressing spring 53. A driving motor rotates the eccentric cam 52.

When the eccentric cam 52 rotates, the pressing lever 51 rotates about the support shaft 51*a* so that the pressing roller 31 moves in a moving direction D1 shown in a broken line in FIG. 2. For example, when the fixing device 20 fixes a toner image T on a transfer sheet P, the eccentric cam 52 is positioned at a pressing position as illustrated in FIG. 2 to press the pressing roller 31 against the fixing belt 21 to form the desired nip portion N. By contrast, when the fixing device 20 does not fix the toner image T on the transfer sheet P in a standby mode or when the transfer sheet P is jammed, the eccentric cam 52 rotates by 180 degrees from the pressing position to separate the pressing roller 31 from the fixing belt 21 or to cause the pressing roller 31 to apply decreased pressure to the fixing belt 21.

Referring to FIG. 2, the following describes normal operations of the fixing device 20 having the above-described structure.

When the image forming apparatus 1 depicted in FIG. 1 is powered on, power is supplied to the heater 25, and the pressing roller 31 starts rotating in the rotation direction R3. Accordingly, friction between the pressing roller 31 and the fixing belt 21 rotates the fixing belt 21 in the rotation direction R2. In other words, the fixing belt 21 is driven by the rotating pressing roller 31.

Thereafter, a transfer sheet P is sent from the paper tray 12 (depicted in FIG. 1) toward the second transfer roller 89 (depicted in FIG. 1) so that a color toner image (e.g., a toner image T) is transferred from the intermediate transfer belt 78 (depicted in FIG. 1) onto the transfer sheet P. A guide guides the transfer sheet P bearing the toner image T in a direction Y10 so that the transfer sheet P bearing the toner image T enters the nip portion N formed between the fixing belt 21 and the pressing roller 31 pressed against the fixing belt 21.

The fixing belt 21 heated by the heater 25 via the heating member 22 applies heat to the transfer sheet P bearing the toner image T. Simultaneously, the fixed member 26 reinforced by the reinforcement member 23 and the pressing roller 31 apply pressure to the transfer sheet P bearing the toner image T. Thus, the heat and the pressure fix the toner image T on the transfer sheet P.

Thereafter, the transfer sheet P bearing the fixed toner image T is sent out of the nip portion N and conveyed in a direction Y11.

Referring to FIGS. 2 and 5, the following describes detailed structure and operations of the fixing device 20 according to this exemplary embodiment.

In the heating member 22, the primary heating portion 22*a* and the secondary heating portion 22*b* are provided in a circumferential direction of the heating member 22. The primary heating portion 22*a* serves as a primary heating portion directly heated by the heater 25 mainly. The secondary heating portion 22*b* serves as a secondary heating portion continuous with and adjacent to the primary heating portion 22*a* and heated mainly by heat conducted from the primary heating portion 22*a*. Specifically, a lower half portion of the heating member 22 corresponds to the primary heating portion 22*a*, and an upper half portion of the heating member 22 corresponds to the secondary heating portion 22*b* according to a position of the heater 25 with respect to the reinforcement member 23.

The reinforcement member 23 divides an inside of the heating member 22 into an upper space provided above the reinforcement member 23 and enclosed by the secondary heating portion 22*b* of the heating member 22 and a lower space provided below the reinforcement member 23 and enclosed by the primary heating portion 22*a* of the heating member 22. The heater 25 is disposed in the lower space enclosed by the primary heating portion 22*a*. In other words, the heater 25 serving as a heater for generating heat is provided between the reinforcement member 23 and the primary heating portion 22*a* of the heating member 22.

For example, the primary heating portion 22*a* of the heating member 22 directly opposes the heater 25 to form a region M1 which directly receives radiation light emitted by the heater 25. Accordingly, the primary heating portion 22*a* of the heating member 22 is directly heated by radiation heat generated by the heater 25. By contrast, the secondary heating portion 22*b* of the heating member 22 opposes the heater 25 via the reinforcement member 23 to form a region M2 which does not directly receive radiation light emitted by the heater 25. Accordingly, the secondary heating portion 22*b* of the heating member 22 is hardly heated by radiation heat generated by the heater 25, but is heated by heat transferred from the primary heating portion 22*a* of the heating member 22. Therefore, when the heating member 22 includes a single material and has a uniform thickness, the secondary heating portion 22*b* provides a heating efficiency lower than a heating efficiency of the primary heating portion 22*a*.

To address this, the secondary heating portion 22*b* has a heat capacity smaller (e.g., lower) than a heat capacity of the primary heating portion 22*a*. Specifically, a material of the secondary heating portion 22*b* has a thermal conductivity greater (e.g., higher) than a thermal conductivity of a material of the primary heating portion 22*a*. For example, the primary heating portion 22*a* includes stainless steel having a low thermal conductivity, and the secondary heating portion 22*b* includes aluminum, copper, or brass having a high thermal conductivity. The primary heating portion 22*a* and the secondary heating portion 22*b* are swaged together at the joint 22*d* so that the primary heating portion 22*a* and the secondary heating portion 22*b* are integrated into a unit.

With the above-described structure, the secondary heating portion 22*b* provides a high heating efficiency or a high thermal conductivity, which is equivalent to a heating efficiency of the primary heating portion 22*a*. The heater 25 heats the heating member 22 substantially uniformly in the circumferential direction of the heating member 22. Accordingly, even when sufficient time is not provided as a warm-up time period in which the fixing belt 21 rotates at idle, temperature of the fixing belt 21 may not vary in the circumferential direction of the fixing belt 21. Consequently, a toner image fixed by the fixing device 20 may not provide variation in fixing property and hot offset. Further, the heating member 22 is thermally expanded substantially uniformly in the primary heating portion 22*a* and the secondary heating portion 22*b*. Accordingly, the heating member 22 may not be expanded and deformed partially. Thus, the fixing belt 21 may not frictionally slide over the heating member 22, and therefore moving performance and durability of the fixing belt 21 may not degrade.

Referring to FIG. 2, the following describes the heating member 22 in detail.

In the fixing device 20 in which the heating member 22 is fixedly provided inside the loop formed by the fixing belt 21 in such a manner that the heating member 22 faces the inner circumferential surface 21*a* depicted in FIG. 4 of the fixing belt 21, the heating member 22 can have a thin thickness to shorten the warm-up time period. However, when the thickness of the heating member 22 is not greater than a predetermined value, the heating member 22 may be thermally deformed when temperature of the heating member 22 increases due to heat generated by the heater 25. Especially, when the heating member 22 is heated quickly, temperature gradient may generate in a diameter direction (e.g., a thickness direction) of the heating member 22. Accordingly, variation in thermal expansion of the heating member 22 in the diameter direction may generate substantial thermal deformation of the heating member 22. When the heating member 22 is deformed slightly within a range of elastic deformation of a material of the heating member 22, the temperature gradient of the heating member 22 and the thermal deformation of the heating member 22 dissipate. However, when the heating member 22 is deformed substantially to exceed the range of elastic deformation of the material of the heating member 22, plastic deformation of the heating member 22 may occur. For example, the heating member 22 may be deformed to have a concave portion and may not recover an original shape. When the heating member 22 is deformed, a clearance provided between the heating member 22 and the fixing belt 21 may change, and therefore the fixing belt 21 may not be heated uniformly. For example, when the heating member 22 is deformed to have the concave portion, the clearance provided between the heating member 22 and the fixing belt 21 may become large at the concave portion of the heating member 22. Namely, the concave portion of the heating member 22 may not heat the fixing belt 21 easily. Consequently, the fixing belt 21 may generate faulty fixing partially. To address this, the heating member 22 may include a material which is not deformed easily. However, usage of such particular material may increase manufacturing costs of the fixing device 20.

Thermal deformation of the heating member 22 generates when the heating member 22 is thermally expanded when the heating member 22 is partially heated. Alternatively, thermal deformation of the heating member 22 generates when residual stress is released when the heating member 22 is processed. Therefore, in order to prevent thermal deformation of the heating member 22, the heating member 22 may have a strength (e.g., a thickness) capable of resisting a deforming force. However, temperature of the secondary heating portion 22*b* of the heating member 22, which is not directly heated by the heater 25 and heated by thermal conduction (e.g., heat conducted from the primary heating portion 22*a*), does not increase quickly compared to the primary heating portion 22*a* of the heating member 22. Therefore, the secondary heating portion 22*b* of the heating member 22 may have a smaller strength (e.g., a smaller thickness or a smaller area). In other words, the secondary heating portion 22*b* of the heating member 22 may have the heat capacity smaller than the heat capacity of the primary heating portion 22*a*.

In the heating member 22 of the fixing device 20 according to this exemplary embodiment, the heat capacity of the secondary heating portion 22*b* is smaller than the heat capacity of the primary heating portion 22*a*. Accordingly, the heating member 22 is deformed within a range not adversely affecting fixing property (e.g., a range of elastic deformation). Thus, a heat capacity of the whole heating member 22 becomes smaller to shorten the warm-up time period. Namely, the heat capacity of the whole heating member 22 can be smaller while the fixing device 20 prevents plastic deformation of the heating member 22 due to thermal expansion of the heating member 22.

According to this exemplary embodiment, two metal materials having different thermal conductivities, respectively, are connected by swaging, welding, or the like at the joint 22*d* depicted in FIG. 5, so that the primary heating portion 22*a* and the secondary heating portion 22*b* have different heat capacities, respectively. Thus, after the primary heating portion 22*a* and the secondary heating portion 22*b* are processed separately, the primary heating portion 22*a* and the secondary heating portion 22*b* are connected to each other or integrated into a unit, resulting in decreased manufacturing costs of the heating member 22.

According to this exemplary embodiment, the heating member 22 includes the primary heating portion 22*a* including stainless steel and the secondary heating portion 22*b* including aluminum having a thickness equivalent to a thickness of the primary heating portion 22*a*. In this case, the heat capacity of the whole heating member 22 is decreased by a range from about 10 percent to about 20 percent compared to when the whole heating member 22 includes stainless steel having a uniform thickness. Thus, the fixing device 20 provides temperature increasing property for increasing the temperature of the heating member 22 efficiently. The secondary heating portion 22*b* including aluminum provides a thermal conductivity by three times higher than a thermal conductivity of the secondary heating portion 22*b* including stainless steel. Accordingly, the secondary heating portion 22*b* provides an increased thermal conductivity in a circumferential direction and a width direction of the secondary heating portion 22*b*, suppressing variation in temperature of the heating member 22 in the circumferential direction of the heating member 22. Further, even when small sheets (e.g., transfer sheets P having a small width) pass through the nip portion N formed between the fixing belt 21 and the pressing roller 31 continuously, temperature increase of both ends of the heating member 22 in the width direction of the heating member 22, that is, in the axial direction of the fixing belt 21, can be suppressed.

As described above, according to this exemplary embodiment, the lubricant is applied between the fixing belt 21 and the heating member 22 to decrease resistance generated between the heating member 22 and the fixing belt 21 sliding over the heating member 22. In order to decrease the heat capacity of the secondary heating portion 22*b*, the secondary heating portion 22*b* may include a through-hole. However, the lubricant may enter the heating member 22 through the through-hole of the secondary heating portion 22*b*. To address this, according to this exemplary embodiment, the heat capacity of the secondary heating portion 22*b* is decreased without forming the through-hole in the secondary heating portion 22*b*. Thus, the lubricant does not enter the heating member 22.

As illustrated in FIG. 5, an inner circumferential surface of the secondary heating portion 22*b* of the heating member 22 is not black-coated. By contrast, an inner circumferential surface of the primary heating portion 22*a* of the heating member 22 is black-coated. In other words, the primary heating portion 22*a* includes the black-coated surface 22*a*1 indicated by alternate long and short dashed lines in FIG. 5.

When a reception surface of a heated body for receiving radiation heat generated by the heater 25 is black-coated, the heated body can absorb heat effectively. However, the black-coated surface may diffuse radiation heat easily while the black-coated surface absorbs radiation heat effectively. Further, the black-coated surface, which diffuses radiation heat easily, needs more heat to compensate for the diffused radiation heat, discouraging energy saving. To address this, according to this exemplary embodiment, the secondary heating portion 22*b* of the heating member 22, which is not directly heated by the heater 25, is not black-coated to suppress heat diffusion. Further, when the secondary heating portion 22*b* is not black-coated, the secondary heating portion 22*b* does not have an extra heat capacity corresponding to a black-coated surface.

Specifically, the inner circumferential surface of the secondary heating portion 22*b* may be a glossy metal surface. In order to decrease an amount of heat radiated from the inner circumferential surface of the heating member 22, heat radiated from the inner circumferential surface of the heating member 22 needs to be suppressed. When the inner circumferential surface of the secondary heating portion 22*b* is the glossy metal surface, the inner circumferential surface of the secondary heating portion 22*b* provides an emissivity in a range from about 0.04 to about 0.10. When the inner circumferential surface of the secondary heating portion 22*b* is black-coated with carbon black, the inner circumferential surface of the secondary heating portion 22*b* provides an emissivity in a range from about 0.95 to about 1.00. Therefore, the glossy metal surface of the secondary heating portion 22*b* can suppress radiation heat substantially. On the other hand, the primary heating portion 22*a* may be black-coated with a coating film agent in which carbon black is dispersed in a high polymer material.

As illustrated in FIG. 5, the secondary heating portion 22*b* is provided downstream from the nip portion N in the rotation direction R2 of the fixing belt 21 depicted in FIG. 4. The primary heating portion 22*a* is provided upstream from the nip portion N in the rotation direction R2 of the fixing belt 21. The slide layer 22*a*2 indicated by a chain double-dashed line in FIG. 5 is provided on an outer circumferential surface of the primary heating portion 22*a*. The slide layer 22*a*2 includes a low-friction material.

In order to prevent or reduce friction resistance generated between the heating member 22 and the fixing belt 21 sliding over the heating member 22, a fluorine-coated slide layer may be provided on an outer circumferential surface of the heating member 22. For example, the slide layer 22*a*2 may serve as a slide layer of low-friction material provided on the outer circumferential surface of the primary heating portion 22*a* because the primary heating portion 22*a* may be thermally expanded substantially, and therefore slide resistance generated between the primary heating portion 22*a* of the heating member 22 and the fixing belt 21 may increase. In other words, when the slide layer 22*a*2 is provided at an entrance side (e.g., an upstream side) of the nip portion N in the rotation direction R2 of the fixing belt 21, a portion of the heating member 22, on which the slide layer 22*a*2 is not provided, has a heat capacity decreased by a heat capacity corresponding to the slide layer 22*a*2.

The fixing belt 21 receives a rotation force from the pressing roller 31 opposing the fixing belt 21. Therefore, the fixing belt 21 contacts the heating member 22 frictionally at the entrance side of the nip portion N mainly. By contrast, the fixing belt 21 hardly contacts the heating member 22 at a position other than the entrance side of the nip portion N. Therefore, even when a slide layer is not provided at an exit side (e.g., a downstream side) of the nip portion N, rotation performance of the fixing belt 21 may not be affected adversely.

A slide layer provided on the heating member 22 and including fluorocarbon resin has an increased thermal resistance with respect to a diameter direction, and therefore heat is transmitted from the slide layer provided on the heating member 22 to the fixing belt 21 slowly. Therefore, when the slide layer is not provided on the secondary heating portion 22*b* of the heating member 22, which is not directly heated by radiation heat generated by the heater 25, the fixing device 20 can be warmed up in a shortened time period. In other words, when the slide layer is not provided on the secondary heating portion 22*b* of the heating member 22 to decrease the heat capacity of the heating member 22, heat is conducted from the heating member 22 to the fixing belt 21 efficiently to shorten a time period taken to increase the temperature of the fixing belt 21.

For example, the slide layer 22*a*2 provided on the outer circumferential surface of the primary heating portion 22*a* may be a coating film in which fluorocarbon resin is dispersed or an eutectoid plating surface with molecular fluorine.

The fixing belt 21 is rotated by the rotating pressing roller 31 due to friction resistance. Accordingly, rotation torque is applied to the fixing belt 21 at the nip portion N. The fixing belt 21 rotates and slides over the heating member 22 at the entrance side of the nip portion N mainly. By contrast, the fixing belt 21 separates from the heating member 22 or contacts the heating member 22 lightly at the exit side of the nip portion N. The heating member 22 is directly heated by the heater 25 at the entrance side of the nip portion N. Accordingly, when the heating member 22 is thermally expanded, the heating member 22 contacts the inner circumferential surface 21*a* of the fixing belt 21 easily at the entrance side of the nip portion N. To address this, lubricating property is needed at the entrance side of the nip portion N at which the heating member 22 contacts the fixing belt 21 easily. In other words, even when a slide layer is not provided at the exit side of the nip portion N, rotation performance of the fixing belt 21 may not be affected adversely. In the fixing device 20, the slide layer is not provided on the outer circumferential surface of the heating member 22 at the exit side of the nip portion N. Accordingly, the heat capacity of the whole heating member 22 is decreased and thermal resistance of the heating member 22 is also decreased. Consequently, the fixing device 20 can be warmed up in a shortened time period.

According to this exemplary embodiment, the primary heating portion 22*a* and the secondary heating portion 22*b* include the two metal materials having the different thermal conductivities, respectively, so that the primary heating portion 22*a* and the secondary heating portion 22*b* have the different heat capacities, respectively. Alternatively, the primary heating portion 22*a* and the secondary heating portion 22*b* may include an identical metal material having different thicknesses, respectively, as illustrated in FIG. 6.

Figure 6:
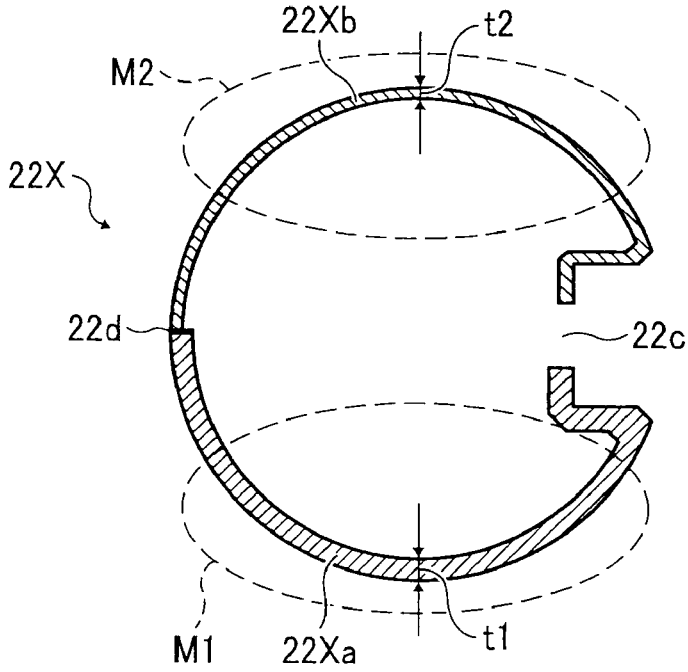
FIG. 6 is a side view of another example of a heating member included in the fixing device shown in FIG. 4.

FIG. 6 is a side view of a heating member 22X. As illustrated in FIG. 6, the heating member 22X includes a primary heating portion 22Xa and a secondary heating portion 22Xb. The other elements of the heating member 22X are equivalent to the elements of the heating member 22 depicted in FIG. 5.

Like the heating member 22 depicted in FIG. 4, the heating member 22X serves as a heating member fixedly provided inside the loop formed by the fixing belt 21 and facing the inner circumferential surface 21*a* of the fixing belt 21. The heating member 22X is heated by the heater 25 (depicted in FIG. 2) so as to heat the fixing belt 21. In the heating member 22X, the primary heating portion 22Xa and the secondary heating portion 22Xb are provided in a circumferential direction of the heating member 22X.

Like in the heating member 22 depicted in FIG. 5, an inner circumferential surface of the secondary heating portion 22Xb may not be black-coated. By contrast, an inner circumferential surface of the primary heating portion 22Xa may be black-coated. The slide layer 22*a*2 including a low-friction material (depicted in FIG. 5) may be provided on an outer circumferential surface of the primary heating portion 22Xa provided upstream from the nip portion N in the rotation direction R2 of the fixing belt 21 depicted in FIG. 4.

In the heating member 22X, a thickness t2 of the secondary heating portion 22Xb is smaller than a thickness t1 of the primary heating portion 22Xa, which is shown as $t2<t1$.

For example, when the thickness t2 of the secondary heating portion 22Xb is a half of the thickness t1 of the primary heating portion 22Xa, the warm-up time period is shortened by a range from about 10 percent to about 15 percent compared to when the thickness t2 of the secondary heating portion 22Xb is equivalent to the thickness t1 of the primary heating portion 22Xa. Since the primary heating portion 22Xa and the secondary heating portion 22Xb include an identical material, the primary heating portion 22Xa is connected to the secondary heating portion 22Xb at the joint 22*d* by welding at decreased manufacturing costs.

Alternatively, instead of connecting the two portions having different thicknesses, respectively, which are the primary heating portion 22Xa and the secondary heating portion 22Xb, a single plate may be pressed to form a thin portion (e.g., the secondary heating portion 22Xb). In this case, the plate may be annealed to prevent thermal deformation of the plate due to residual stress applied to the thin portion by pressing.

As described above, in the heating member 22 (depicted in FIG. 5) or the heating member 22X (depicted in FIG. 6) serving as a heating member, the secondary heating portion 22*b* or 22Xb serving as a secondary heating portion continuous with and adjacent to the primary heating portion 22*a* or 22Xa and heated by heat conducted from the primary heating portion 22*a* or 22Xa has the heat capacity smaller than the heat capacity of the primary heating portion 22*a* or 22Xa serving as a primary heating portion directly heated by the heater 25 (depicted in FIG. 2) serving as a heater. Accordingly, even when the image forming apparatus 1 depicted in FIG. 1 forms a toner image on a transfer sheet at a high speed with a shortened warm-up time period or a shortened first print time period, the fixing device 20 depicted in FIG. 2 can fix the toner image on the transfer sheet properly. Further, the heater 25 heats the heating member 22 or 22X uniformly in the circumferential direction of the heating member 22 or 22X. Consequently, the toner image fixed by the fixing device 20 may not provide variation in fixing property and hot offset. Further, moving performance and durability of the fixing belt 21, serving as a belt, may not degrade.

In the fixing device 20 according to this exemplary embodiment, the pressing roller 31 serves as a pressing rotary member. Alternatively, a pressing belt may serve as a pressing rotary member to provide the above-described effects.

In the fixing device 20 according to this exemplary embodiment, the fixing belt 21 having a plurality of layers serves as a belt. Alternatively, an endless fixing film including polyimide, polyamide, fluorocarbon resin, and/or metal may serve as a belt to provide the above-described effects.

In the fixing device 20 according to this exemplary embodiment, the heater 25 provided inside the heating member 22 or 22X serves as a heater for heating the heating member 22 or 22X in a heater method. Alternatively, an exciting coil may serve as a heater for heating the heating member 22 or 22X in an induction heating method. Yet alternatively, a resistance heating element may serve as a heater for heating the heating member 22 or 22X. In either case, the fixing device 20 may include a primary heating portion mainly heated directly by the heater and a secondary heating portion mainly heated by heat conducted from the primary heating portion. The secondary heating portion has a lower heat capacity to provide the above-described effects.

For example, when the fixing device 20 uses the induction heating method, the primary heating portion of the heating member may be a heat generating portion which resists an eddy current generated by a magnetic force of the exciting coil to generate heat. The secondary heating portion of the heating member may be a portion other than the heat generating portion.

In the fixing device 20 according to this exemplary embodiment, the single primary heating portion 22*a* or 22Xa and the single secondary heating portion 22*b* or 22Xb are provided in the circumferential direction of the heating member 22 or 22X. Alternatively, a plurality of primary heating portions 22*a* or 22Xa and a plurality of secondary heating portions 22*b* or 22Xb may be provided in the circumferential direction of the heating member 22 or 22X. For example, a plurality of heaters 25 may be provided at a plurality of locations, or radiation light may be blocked at a plurality of positions. In this case also, the plurality of primary heating portions 22*a* or 22Xa and the plurality of secondary heating portions 22*b* or 22Xb may have desired heat capacities, respectively, to provide the above-described effects.

In the fixing device 20 according to this exemplary embodiment, the reinforcement member 23 is provided inside the heating member 22 or 22X as illustrated in FIG. 2. Alternatively, the reinforcement member 23 may not be provided inside the heating member 22 or 22X but the primary heating portion 22*a* or 22Xa and the secondary heating portion 22*b* or 22Xb may be provided in the heating member 22 or 22X. For example, a reflection plate may be provided in a part of a circumferential direction of the heater 25, or the heater 25 may be disposed at a position shifted from a center of the heating member 22 or 22X. In this case also, the primary heating portion 22*a* or 22Xa and the secondary heating portion 22*b* or 22Xb may have desired heat capacities, respectively, to provide the above-described effects.

Figure 7:
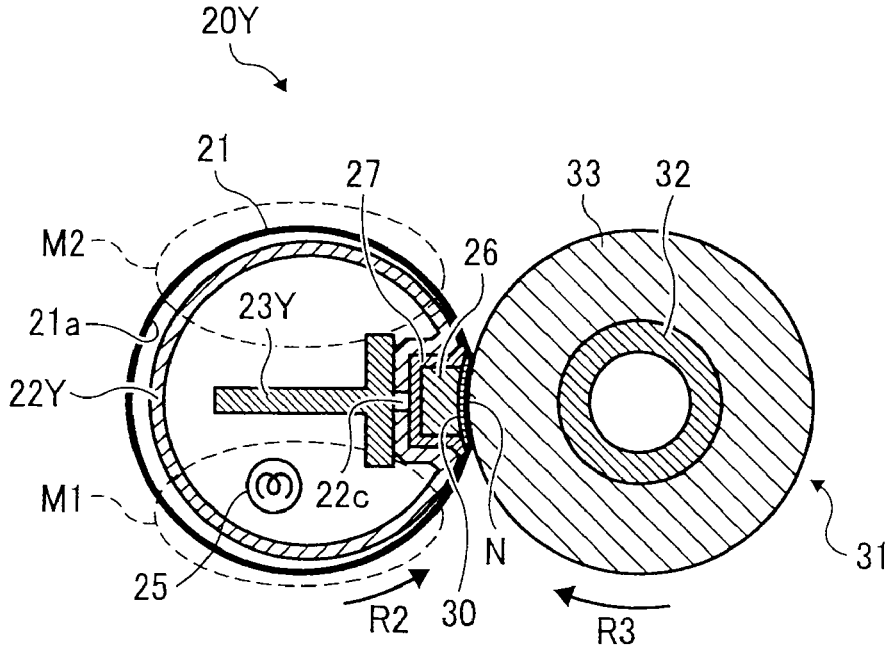
FIG. 7 is a schematic view of a fixing device according to another exemplary embodiment of the present invention.
Figure 8:
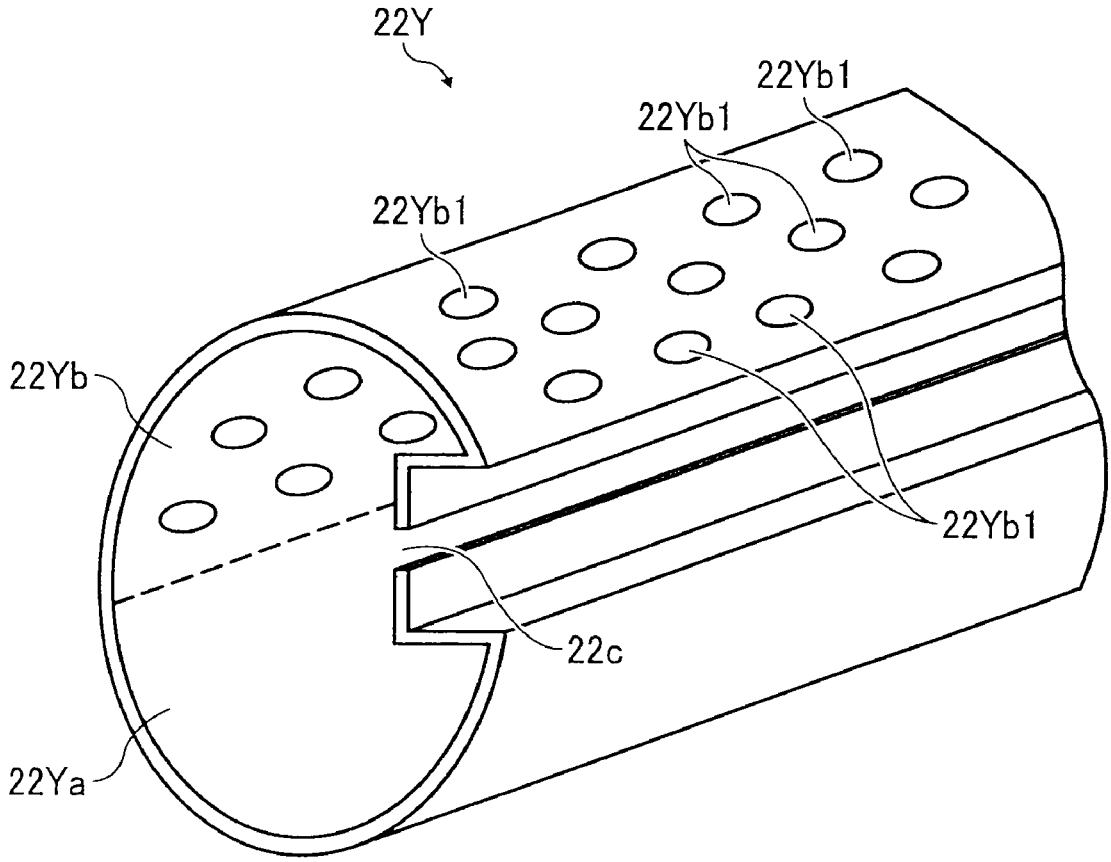
FIG. 8 is a perspective view of a heating member included in the fixing device shown in FIG. 7.

Referring to FIGS. 7 and 8, the following describes a fixing device 20Y according to another exemplary embodiment. FIG. 7 is a schematic view of the fixing device 20Y. As illustrated in FIG. 7, the fixing device 20Y includes the fixing belt 21, a heating member 22Y, a reinforcement member 23Y, the heater 25, the fixed member 26, a heat insulator 27, a lubricant holder 30, and the pressing roller 31. The fixing belt 21 includes the inner circumferential surface 21*a*. The heating member 22Y includes the opening 22*c*. The pressing roller 31 includes the core metal 32 and the elastic layer 33.

FIG. 8 is a perspective view of the heating member 22Y. As illustrated in FIG. 8, the heating member 22Y includes a primary heating portion 22Ya, a secondary heating portion 22Yb, and the opening 22*c*. The secondary heating portion 22Yb includes through-holes 22Yb1.

In the fixing device 20Y, the heating member 22Y, the reinforcement member 23Y, and peripheral elements (e.g., the lubricant holder 30) of the fixed member 26 have structures different from the structures of the heating member 22 or 22X, the reinforcement member 23, and the peripheral elements of the fixed member 26 included in the fixing device 20 depicted in FIG. 2. In other words, the heating member 22Y replaces the heating member 22 or 22X. The reinforcement member 23Y replaces the reinforcement member 23. The other elements of the fixing device 20Y are equivalent to the elements of the fixing device 20.

As illustrated in FIG. 7, like the heating member 22 depicted in FIG. 4, the heating member 22Y serves as a heating member fixedly provided inside the loop formed by the fixing belt 21 and facing the inner circumferential surface 21*a* of the fixing belt 21. The heating member 22Y is heated by the heater 25 so as to heat the fixing belt 21.

As illustrated in FIG. 7, the reinforcement member 23Y has a T-shape, and serves as a reinforcement member fixedly provided inside the heating member 22Y and facing an inner circumferential surface of the heating member 22Y to directly or indirectly contact the fixed member 26 to reinforce the fixed member 26. The heater 25 serving as a heater for generating heat is provided between the reinforcement member 23Y and the primary heating portion 22Ya (depicted in FIG. 8) of the heating member 22Y.

The porous lubricant holder 30 is provided on the fixed member 26. Specifically, the lubricant holder 30 includes a mesh sheet member netted with fluorocarbon fiber. A lubricant, such as silicon oil and/or fluorine grease, is held or impregnated in the lubricant holder 30. The lubricant holder 30 is provided inside the loop formed by the fixing belt 21 and contacts the inner circumferential surface 21*a* of the fixing belt 21 at the nip portion N. In other words, the lubricant holder 30 is provided between the fixed member 26 and the fixing belt 21.

With the above-described structure, the lubricant holder 30 supplies the lubricant to the inner circumferential surface 21*a* of the fixing belt 21 to decrease resistance generated between the fixed member 26 and the fixing belt 21 sliding over the fixed member 26 and resistance generated between the heating member 22Y and the fixing belt 21 sliding over the heating member 22Y, decreasing wear of the fixed member 26, the fixing belt 21, and the heating member 22Y.

The heat insulator 27 surrounds the fixed member 26. The lubricant holder 30 is not directly heated by the heating member 22Y easily. Accordingly, the lubricant held by the lubricant holder 30 may not be volatilized and degraded by heat. In other words, the lubricant holder 30 stably supplies the lubricant to the inner circumferential surface 21*a* of the fixing belt 21 over time. The heat insulator 27 may include a heat-resistant, high-insulation material such as rubber, resin, felt, and/or ceramic sheet.

As illustrated in FIG. 8, in the heating member 22Y, the primary heating portion 22Ya and the secondary heating portion 22Yb are provided in a circumferential direction of the heating member 22Y. Like in the heating member 22 depicted in FIG. 5, an inner circumferential surface of the secondary heating portion 22Yb may not be black-coated. By contrast, an inner circumferential surface of the primary heating portion 22Ya may be black-coated. The slide layer 22*a*2 including a low-friction material (depicted in FIG. 5) may be provided on an outer circumferential surface of the primary heating portion 22Ya provided upstream from the nip portion N in the rotation direction R2 of the fixing belt 21 depicted in FIG. 7.

A plurality of through-holes 22Yb1 is provided in the secondary heating portion 22Yb so that the primary heating portion 22Ya and the secondary heating portion 22Yb have different heat capacities, respectively.

For example, when the plurality of through-holes 22Yb1 was provided in such a manner that the secondary heating portion 22Yb occupied a half area with respect to an area of the primary heating portion 22Ya under a condition in which the heater 25 (e.g., a halogen heater) depicted in FIG. 7 output 1,200 watts of power and the heating member 22Y included aluminum having a thickness of 0.4 mm, the secondary heating portion 22Yb provided with the through-holes 22Yb1 shortened a warm-up time period of the fixing device 20Y depicted in FIG. 7 by a range from 10 percent to 15 percent compared to a secondary heating portion provided with no through-holes 22Yb1.

Thus, the secondary heating portion 22Yb provided with the plurality of through-holes 22Yb1 is useful when the lubricant is not applied between the heating member 22Y and the fixing belt 21 depicted in FIG. 7, for example, when a certain gap is provided between the heating member 22Y and the fixing belt 21 at a position other than the nip portion N and the lubricant holder 30 decreases friction between the fixed member 26 depicted in FIG. 7 and the fixing belt 21 at the nip portion N.

In the heating member 22Y of the fixing device 20Y according to this exemplary embodiment, like in the heating member 22 depicted in FIG. 5 or the heating member 22X depicted in FIG. 6, the heat capacity of the secondary heating portion 22Yb serving as a secondary heating portion continuous with and adjacent to the primary heating portion 22Ya and heated by heat conducted from the primary heating portion 22Ya is smaller than the heat capacity of the primary heating portion 22Ya serving as a primary heating portion directly heated by the heater 25 serving as a heater.

Accordingly, even when the image forming apparatus 1 depicted in FIG. 1 forms a toner image on a transfer sheet at a high speed with a shortened warm-up time period or a shortened first print time period, the fixing device 20Y depicted in FIG. 7 can fix the toner image on the transfer sheet properly. Further, the heater 25 heats the heating member 22Y uniformly in the circumferential direction of the heating member 22Y. Consequently, the toner image fixed by the fixing device 20Y may not provide variation in fixing property and hot offset. Further, moving performance and durability of the fixing belt 21, serving as a belt, may not degrade.

As described above, in a heating member (e.g., the heating member 22 depicted in FIG. 5, the heating member 22X depicted in FIG. 6, or the heating member 22Y depicted in FIG. 8), a heat capacity of a secondary heating portion (e.g., the secondary heating portion 22*b* depicted in FIG. 5, the secondary heating portion 22Xb depicted in FIG. 6, or the secondary heating portion 22Yb depicted in FIG. 8) heated by heat conducted from a primary heating portion (e.g., the primary heating portion 22*a* depicted in FIG. 5, the primary heating portion 22Xa depicted in FIG. 6, or the primary heating portion 22Ya depicted in FIG. 8) is smaller than a heat capacity of the primary heating portion directly heated by a heater (e.g., the heater 25 depicted in FIG. 2 or 7).

Accordingly, even when an image forming apparatus (e.g., the image forming apparatus 1 depicted in FIG. 1) forms a toner image on a transfer sheet at a high speed with a shortened warm-up time period or a shortened first print time period, a fixing device (e.g., the fixing device 20 depicted in FIG. 2 or the fixing device 20Y depicted in FIG. 7) can fix the toner image on the transfer sheet properly. Further, the heater heats the heating member uniformly in a circumferential direction of the heating member. Consequently, the toner image fixed by the fixing device may not provide variation in fixing property and hot offset. Further, moving performance and durability of a belt (e.g., the fixing belt 21 depicted in FIG. 2 or 7) may not degrade.

In the above-described exemplary embodiments, when the fixed member, the heating member, and the reinforcement member are "fixedly provided", the fixed member, the heating member, and the reinforcement member are held or supported without being rotated. Therefore, even when a force applier such as a spring presses the fixed member against the nip portion, for example, the fixed member is "fixedly provided" as long as the fixed member is held or supported without being rotated.

In the above-described exemplary embodiments, the "primary heating portion" is directly heated by the heater at a higher rate. Therefore, the "primary heating portion" is heated by thermal conduction at a lower rate, if any.

By contrast, the "secondary heating portion" is heated by heat conducted from the primary heating portion at a higher rate. Therefore, the "secondary heating portion" is directly heated by the heater at a lower rate, if any.

The present invention has been described above with reference to specific exemplary embodiments. Note that the present invention is not limited to the details of the embodiments described above, but various modifications and enhancements are possible without departing from the spirit and scope of the invention. It is therefore to be understood that the present invention may be practiced otherwise than as specifically described herein. For example, elements and/or features of different illustrative exemplary embodiments may be combined with each other and/or substituted for each other within the scope of the present invention.

What is claimed is:

1. A fixing device comprising:

a flexible endless belt to move in a predetermined direction to heat and melt a toner image on a recording medium;

a pressing rotary member pressed against the belt to form a nip portion to nip and convey the recording medium bearing the toner image as the recording medium passes between the pressing rotary member and the belt;

a heater to generate heat; and a heating member fixedly provided inside a loop formed by the belt and facing an inner circumferential surface of the belt, the heating member heated by the heater to heat the belt, the heating member comprising:

a primary heating portion directly heated by the heater; and a secondary heating portion continuous with and adjacent to the primary heating portion and heated by heat conducted from the primary heating portion, the primary heating portion and the secondary heating portion being provided in a circumferential direction of the heating member, the secondary heating portion having a heat capacity smaller than a heat capacity of the primary heating portion.

2. The fixing device according to claim 1, wherein a thickness of the secondary heating portion of the heating member is smaller than a thickness of the primary heating portion of the heating member.

3. The fixing device according to claim 1, wherein a thermal conductivity of a material of the secondary heating portion of the heating member is greater than a thermal conductivity of a material of the primary heating portion of the heating member.

4. The fixing device according to claim 1, further comprising a lubricant applied between the belt and the heating member.

5. The fixing device according to claim 1, wherein the secondary heating portion of the heating member comprises a plurality of through-holes.

6. The fixing device according to claim 1, wherein an inner circumferential surface of the primary heating portion of the heating member is black-coated.

7. The fixing device according to claim 1, wherein the secondary heating portion of the heating member is provided downstream from the nip portion in a direction of rotation of the belt, and the primary heating portion of the heating member is provided upstream from the nip portion in the direction of rotation of the belt, and wherein the heating member comprises a slide layer of low-friction material provided on an outer circumferential surface of the primary heating portion of the heating member.

8. The fixing device according to claim 1, further comprising:

a fixed member fixedly provided inside the loop formed by the belt and facing the inner circumferential surface of the belt, the fixed member pressed against the pressing rotary member via the belt to form the nip portion; and a reinforcement member fixedly provided inside the heating member and facing an inner circumferential surface of the heating member to directly or indirectly contact the fixed member to reinforce the fixed member, wherein the heater is provided between the reinforcement member and the primary heating portion of the heating member.

9. An image forming apparatus comprising:

a fixing device comprising:

a flexible endless belt to move in a predetermined direction to heat and melt a toner image on a recording medium;

a pressing rotary member pressed against the belt to form a nip portion to nip and convey the recording medium bearing the toner image as the recording medium passes between the pressing rotary member and the belt;

a heater to generate heat; and a heating member fixedly provided inside a loop formed by the belt and facing an inner circumferential surface of the belt, the heating member heated by the heater to heat the belt, the heating member comprising:

a primary heating portion directly heated by the heater; and a secondary heating portion continuous with and adjacent to the primary heating portion and heated by heat conducted from the primary heating portion, the primary heating portion and the secondary heating portion being provided in a circumferential direction of the heating member, the secondary heating portion having a heat capacity smaller than a heat capacity of the primary heating portion.

10. The image forming apparatus according to claim 9, wherein a thickness of the secondary heating portion of the heating member is smaller than a thickness of the primary heating portion of the heating member.

11. The image forming apparatus according to claim 9, wherein a thermal conductivity of a material of the secondary heating portion of the heating member is greater than a thermal conductivity of a material of the primary heating portion of the heating member.

12. The image forming apparatus according to claim 9, further comprising a lubricant applied between the belt and the heating member.

13. The image forming apparatus according to claim 9, wherein the secondary heating portion of the heating member comprises a plurality of through-holes.

14. The image forming apparatus according to claim 9, wherein an inner circumferential surface of the primary heating portion of the heating member is black-coated.

15. The image forming apparatus according to claim 9, wherein the secondary heating portion of the heating member is provided downstream from the nip portion in a direction of rotation of the belt, and the primary heating portion of the heating member is provided upstream from the nip portion in the direction of rotation of the belt, and wherein the heating member comprises a slide layer of low-friction material provided on an outer circumferential surface of the primary heating portion of the heating member.

16. The image forming apparatus according to claim 9, wherein the fixing device further comprises:

a fixed member fixedly provided inside the loop formed by the belt and facing the inner circumferential surface of the belt, the fixed member pressed against the pressing rotary member via the belt to form the nip portion; and a reinforcement member fixedly provided inside the heating member and facing an inner circumferential surface of the heating member to directly or indirectly contact the fixed member to reinforce the fixed member, wherein the heater is provided between the reinforcement member and the primary heating portion of the heating member.

* * * * *